US005447009A

United States Patent [19]

Oleksy et al.

[11] Patent Number: 5,447,009

[45] Date of Patent: Sep. 5, 1995

[54] METHOD AND APPARATUS OF BANDED WRAPPING OF A PALLETIZED LOAD

[75] Inventors: Thomas M. Oleksy, Chesterfield, Mo.; Faruk M. Turfan, Trudeau Borssard, Canada

[73] Assignee: Newtec International (Societe Anonyme), France

[21] Appl. No.: 124,866

[22] Filed: Sep. 22, 1993

[51] Int. Cl.[6] ..... B65B 11/04; B65B 53/00; B65B 51/10

[52] U.S. Cl. ..... 53/399; 53/441; 53/556; 53/587; 53/588; 53/375.9; 53/389.3

[58] Field of Search ..... 53/211, 375.9, 389.3, 53/399, 441, 556, 587, 588

[56] References Cited

U.S. PATENT DOCUMENTS

| | | | |
|---|---|---|---|
| 4,050,221 | 9/1977 | Lancaster et al. | 53/587 X |
| 4,235,062 | 11/1980 | Lancaster, III et al. | 53/399 |
| 4,432,185 | 2/1984 | Geisinger . | |
| 4,619,102 | 10/1986 | Geisinger | 53/587 |
| 4,671,043 | 6/1987 | Forni et al. | 53/556 X |
| 4,807,427 | 2/1989 | Casteel et al. | 53/556 |
| 4,905,451 | 3/1990 | Jaconelli et al. | 53/410 |
| 5,003,752 | 4/1991 | Matsumoto | 53/399 |
| 5,016,427 | 5/1991 | Thimon . | |
| 5,138,818 | 8/1992 | Humphrey | 53/587 X |
| 5,168,685 | 12/1992 | Suzuki | 53/587 X |
| 5,195,296 | 3/1993 | Matsumoto | 53/399 |
| 5,203,671 | 4/1993 | Cawley . | |

FOREIGN PATENT DOCUMENTS 9207761 5/1992 WIPO .

*Primary Examiner*—Linda Johnson
*Attorney, Agent, or Firm*—Vickers, Daniels & Young

[57] ABSTRACT

A wrapping machine for wrapping a palletized load is provided with a film carriage having a spool of film. A means for unwinding the film from the spool from an upstream winding position to a downstream position in accordance with a selected path where it is applied to the load is also provided. Prestretching rollers for prestretching the film before it is applied to the load are contained on the film carriage. Cutting blades are used to pierce the film, downstream of the prestretching rollers, into longitudinally extending strips. The strips are then separated into longitudinally extending bands by a separating roller. The bands are applied to a load by the carriage which slidably moves up and down along a support column in combination with a turntable upon which the load rotates.

39 Claims, 6 Drawing Sheets

METHOD AND APPARATUS OF BANDED WRAPPING OF A PALLETIZED LOAD

The present invention relates to a method and apparatus for wrapping a palletized load with structural plastic film in a manner that creates open spaces between adjacent strips of film on the load.

INCORPORATION BY REFERENCE

Thimon et al. U.S. Pat. No. 5,016,427 is incorporated by reference herein so that background prestretching devices known in the art need not be described in detail herein.

BACKGROUND OF THE INVENTION

Pallet wrapping using structural plastic film in various methods is well known in the packaging art. Various machines and apparatus are used to place plastic film about a palletized load. Generally, the method employed involves dispensing a plastic film from a film reel and helicoidally placing the film about the load. The film improves the cohesiveness of a palletized load, thereby preventing elements of the load from being displaced. This increases safety in the work environment preventing falling objects or spilled loads and increases material-handling efficiency. Wrapping a load also works to protect the elements therein from the outside environmental influences such as water and dust.

However, it has been found that it is not practical to wrap certain types of loads in the manner described above. Since no spacing is left between adjacent strips of film in the above-described wrapping operation, air is not allowed to circulate to the individual elements stacked within the palletized load. This can be very detrimental to palletized loads containing foodstuffs such as fresh produce, hot-wrapped products or products palletized in a freezing environment. Each of these type of loads require air spacing between plastic film strips in order to allow the products to "breathe." Without such air spaces, condensation will usually form in the interior of the load inside the plastic wrap. This condensation encourages and hastens the spoiling of certain food stuffs. Additionally, hot-wrapped products are not allowed to cool properly. This can be detrimental to the product itself and, additionally, can be detrimental to the integrity of the wrapped load since uncontrolled heating and cooling of the film material can change the composition and strength properties of the plastic film wrap. Moreover, products which are palletized in a freezing environment will necessarily thaw during warming give up moisture that had previously condensed during cooling. Depending on the products contained therein, this condensation may result in spoiling of the product. Additionally, condensation may destroy the integrity of corrugated boxes or other packaging elements which comprise the palletized load.

A number of solutions have been proposed in order to allow palletized loads to "breathe." The most common of these solutions is to place a netting about or around the palletized load. While netting allows a product to "breathe", it has other inherent problems. The most obvious of these problems is that netting is not inherently adaptable to automatic wrapping of a load. Therefore, it is labor intensive, time consuming and expensive. Further, netting does not have the advantageous property of plastic film wrap, notably the capacity of stretching elastically and being adhesive to at least other strips of plastic film wrap. As a result, netting does not have the cohesive holding quality of plastic film and thus a palletized load covered with netting is not as durable and is more susceptible to individual elements coming free from the load. Finally, netting is easily snagged by passing objects as a palletized load is moved from one position to another. Snagging just one portion of the netting can result in an entire load being pulled from a pallet.

It has also been proposed to package a load by taking packaging film and cutting it into strips of reduced width. Each strip of reduced width is then wound about a load such that spaces are left therebetween to allow the package to "breathe." Such a solution is not advantageous in that individual strips of film of reduced width are weak and susceptible to stresses and tension. Therefore, only slight resistance when winding such narrow strips of film often results in breaking of the film. Because of this weakness, the film cannot be wrapped with the tension which would otherwise be desired and thus the load is not advantageously unitized. Since each strip is narrow, this method also increases the amount of time required to wrap each load.

Another proposed method has been to reduce the width of a film strip by reducing the flat section into a narrow rope or cord. This has the advantage of increasing the tensile strength of the film since, while the width is reduced, the thickness of the film is increased. However, such method has the disadvantage of substantially increasing the material cost to wrap a singular load in that the entire width of film is reduced to one rope or cord. Furthermore, such a method does not always properly secure individual element products to the pallet. The individual cords do not provide a sufficient width to secure the products and are often placed varying distances from each other wherein certain individual elements of the load are not secured at all. Moreover, such a wrapping method substantially increases the amount of time required to wrap a singular load. The bunching of a large width of film into a rope or cord is also undesirable in appearance and increases the susceptibility of the film catching or snagging on adjacent objects as a load is moved from place to place.

Ropes or cords of plastic film also present problems in attaching the end of the film to the load. As is often the case, a section of roped plastic film does not have the adhesive quality that the entire width of film has when placed on a load. It is therefore necessary to gather a cord together at the end and tie it off to the load or to the pallet. This is time consuming and labor intensive and severely reduces the economic advantage of roping a palletized load. When it is necessary to wrap palletized loads in a steady constant and cyclical manner, the roping operation described above becomes impractical.

Finally, it has been proposed to wind the full width of film to secure the lower part of the goods on the pallet and subsequently to cut the film into strips. These strips are then wound about the load, strips having spaces therebetween and, before the wrap is finished, the cutting operation is stopped and the full width of the film is restored so that the full width of the film may be wound about the upper part of the goods for at least one turn. While this method corrects many of the problems inherent in the prior art, it also presents other problems. For instance, cutting the film web into strips has presented problems in that the film web is stretchable and elastic. Often the cutting mechanism does not actually cut the film but instead only creases the film web. The elasticity of the film also causes bunching at the cutting edge, inaccurate cutting and tearing of the film web. Further, the proposed method requires the use of a full web of film at both the top and bottom of the pallet. The use of a full web effectively seals both the top and bottom layers of a palletized load within a non-breathable film strip. This is undesirable for all the reasons set forth above. Specifically, fresh produce in the top and bottom layers will more easily spoil since condensation cannot escape, hot-wrapped products are unable to cool properly and products palletized in a freezing environment are unable to thaw properly.

SUMMARY OF THE INVENTION

Accordingly, it is a principal object of the invention to provide a method and apparatus which overcomes the disadvantages of prior art palletized wrappers in that a palletized load is economically secured and unitized while allowing each of the individual elements in a palletized load to "breathe."

This object, along with other features of the invention, is achieved in an apparatus for wrapping a palletized load with stretchable plastic film web. The apparatus includes a spool of film which is prestretched by a prestretching apparatus before applying the film to the load. The prestretched film is then perforated or pierced by a cutting apparatus into transversely extending strips. The transversely extending strips are then separated in order that spaces are placed therebetween and the film strips are then placed on the load by means of relative rotation of one of either the load or the spool of film relative to the other in combination with moving the spool of film as it unwinds between the top and bottom sides of the load. The cutting apparatus includes a retractility feature wherein the cutting edges of the cutting apparatus may be in an engaged or disengaged position. This necessarily provides that the wrapping machine may be used in a known manner for providing full width film wrapping of film about a load. However, when it is desirable to wrap a load so that it is breathable, the cutting edges are placed in the engaged position to provide the desired load retention in combination with the breathability feature.

In order to induce spacing between the transversely extending strips and form the strips into bands of film, a device is placed in the path of the strips. The device has both concave and convex portions along its outer peripheral edges. Each of the strips are under tension as the strip passes over the device, each has a tendency to slide off the convex edges or peripheral ridges of the device and fall into the concave portion or peripheral grooves. Thus, since each of the strips is within a peripheral groove or concave portion of the device, the peripheral ridge or convex portion of the device serves to separate adjacent strips. This device provides the spacing between transverse strips which forms the strips into bands of film which allows for breathability of the load when the bands of film are placed upon the load.

The prestretching apparatus provides for a more efficient cutting operation. In the past, it has been found that it has been difficult to accurately cut a film width into strips with a cutting apparatus while the film is being placed upon a load. Since the film web is of stretchable plastic film, the cutting apparatus does not always immediately perforate the film. Sometimes the cutting apparatus only creases the film. Additionally, the elasticity of an unstretched film web causes bunching at the cutting edge, inaccurate cutting and tearing of the film web. These features are highly undesirable. Therefore, the present invention incorporates the use of a prestretching means prior to cutting or perforating the film web. The prestretching apparatus reduces the thickness of the film web and removes much of the elasticity of the film prior to the film being cut or perforated. Thus, the prestretching apparatus eliminates the prior art problems of bunching at the cutting edge or unwanted tearing of the film web.

In accordance with a more specific feature of the invention, a heating mechanism is used in order to fully automate the entire wrap cycle which utilizes bands of film. Previous methods of wrapping a load with bands of film have undesirably required that the full, uncut width of film web be placed on the sides of the load adjacent the bottom and top of the load in order to provide adequate tension and unitization of the bands of film on other portions of the load. However, this previous method, which requires encasing at least the top and bottom layers of the load within the full width of film web, prevents breathability at the top and bottom layers. Thus, the present invention provides a heating apparatus which can be used at any time during the wrap cycle and especially at the beginning or end of the wrap cycle to affix each of the bands of film either to the load, or to layers of film web strips already placed on the load eliminating the need for a full web of film at the sides adjacent the bottom and the top of the load and further eliminating the manual step of attaching the end of film to a wrapped load.

It is thus a principal object of the invention to provide an improved method and apparatus for wrapping a palletized load which provides optimum load retention while allowing elements of the load to "breathe" and air to circulate to elements of the load.

It is yet another object of the invention to provide an apparatus in which a single film roll is used to provide a plurality of longitudinally extending strips having spaces therebetween onto a palletized load.

Still yet another object of the invention is to provide an apparatus which allows versatility between wrapping a load with the full width of film web and wrapping a load with film strips having spaces therebetween.

Yet another object of the invention is to provide an apparatus and method in order to better control cutting a film web into smaller longitudinally extending strips.

It is yet another object of the present invention to provide an apparatus and method to provide greater film tension to the load and, thus, greater load retention as well as reduced material cost in wrapping a load.

It is a further object of the invention to fully automate an entire wrapping cycle utilizing a plurality of longitudinally extending strips while eliminating the need to provide a full web width at the beginning or end of the wrap cycle.

A yet further object of the present invention includes heating the film web bands to automate a wrap cycle and eliminate the requirement of manual affixation of the ends of the film to the load.

These and other objects of the invention will become apparent to those skilled in the art upon reading and understanding the detailed description in the following section.

BRIEF DESCRIPTION OF THE DRAWINGS

The invention may take physical form in certain parts and in ranges of parts, a preferred embodiment of which will be described in detail and illustrated in the accompanying drawings which form a part hereof and wherein.

THE PREFERRED EMBODIMENT

Figure 1:
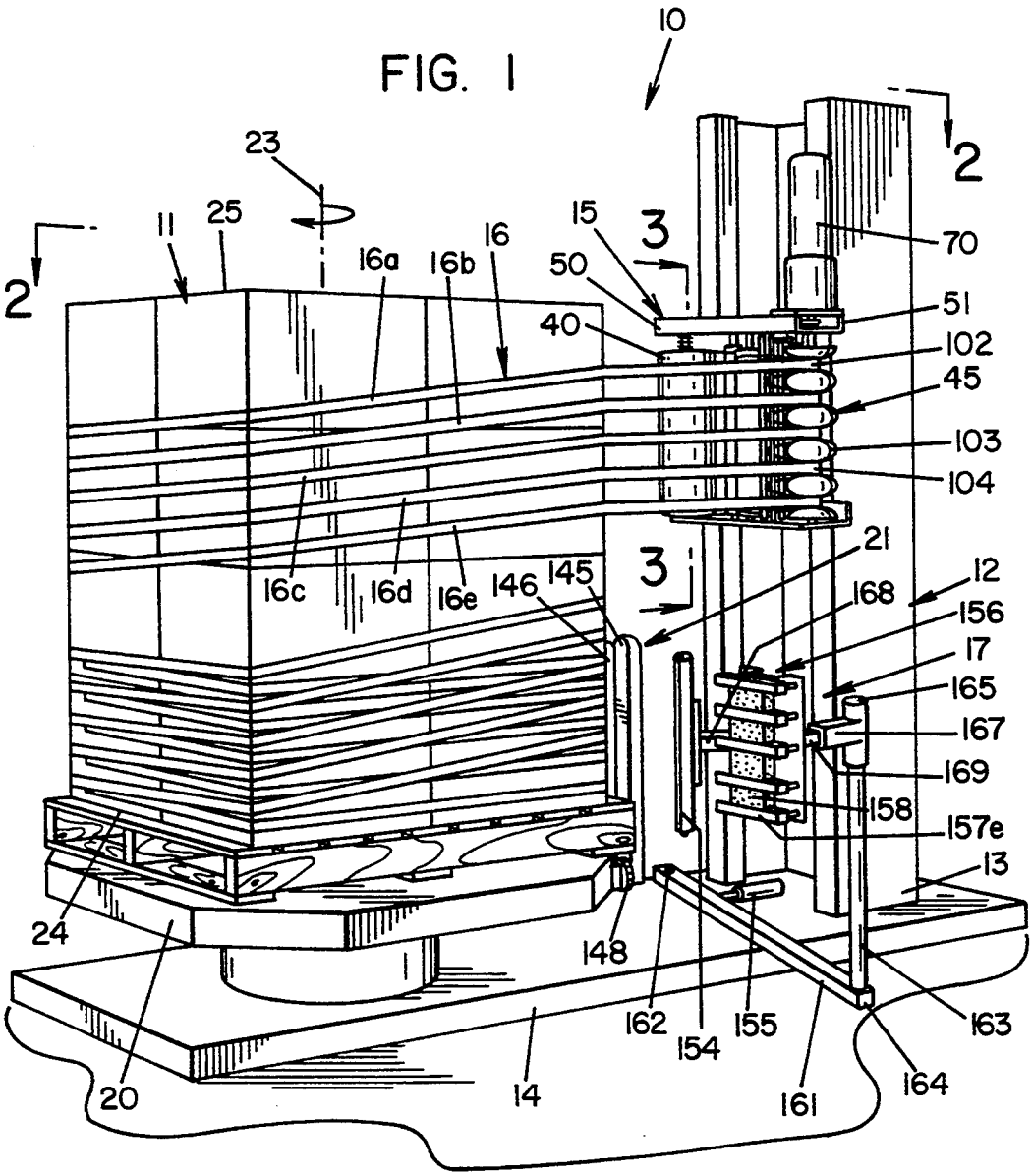
FIG. 1 is a pictorial view illustrating a pallet wrapping machine in accordance with the present invention.

Referring to the drawings wherein the showings are for the purpose of illustrating a preferred embodiment of the invention only and not for the purpose of limiting same, a wrapping machine 10 for wrapping a palletized load 11 is illustrated in FIG. 1. The wrapping machine 10 comprises a vertical support column 12 attached at its lower end portion 13 to base 14. Support column 12 slidably supports film carriage 15 in order that film carriage 15 is capable of moving vertically along support column 12. Film carriage 15 is capable of delivering stretchable plastic film web 16 to load 11 as film carriage 15 moves along support column 12. Attached to base 14 is heat seal mechanism 17, which is capable of being engaged against load 11 and plastic film web 16 to permanently attach plastic film 16 to load 11 at the beginning and/or end of a wrap cycle.

It will be appreciated, and it is well known in the prior art, that a palletized load 11 is placed upon turntable 20 in preparation of the wrapping operation by any number of known means such as a conveyor. The wrapping operation is begun by affixing the end of plastic film 16 into clamp 21. Wrapping machine 10 is then actuated in order that turntable 20, along with clamp 21 which is attached to turntable 20, begins to rotate about vertical axis 23. Once turntable 20 and load 11, which is placed thereon, rotate to between three-fourths of one revolution and one revolution (i.e. 270°–360°). Clamp 21 pivots from a substantially vertical position to a position removed from the path of film 16 between carriage 15 and load 11 in order that plastic film 16 may overlap or partially overlap that area of the load 11 which has already been placed with a layer of film 16. Load 11 and turntable 20 continue to rotate about axis 23 as plastic film 16 is dispensed from film carriage 15 to apply lateral strips or bands of film 16 to the load.

During rotation, film carriage 15 moves vertically along support column 12 in order that load 11 is substantially covered with lateral strips or bands of plastic film 16. While the preferred method involves a helicoidal wrapping operation, any number of patterns can be used. In the preferred embodiment, load 11 is helicoidally wrapped in a spiral fashion from the bottom 24 of load 11 to the top 25 of load 11. Load 11 is then helicoidally, spirally wrapped downward from top 25 to bottom 24 of load 11. At this point, heat seal mechanism 17 is engaged in coordination with clamp 21 so that film 16 is severed to disengage film 16 placed on the load from film 16 being dispensed from film carriage 15. The severed or terminal end 26 of film 16 at the load is sealed in place by heat seal mechanism 17 to eliminate the usual manual steps required to engage the end of film 16 onto the load. Load 11 is then moved off of the turntable in order that another load may be placed in position for wrapping. Since clamp 21 retains a portion of film 16 standing between film carriage 15 and clamp 21, initial end 27, another load may be wrapped without any manual setup in order to affix the initial end 27 of film 16 to the load.

It is to be understood that each of the above-referenced steps, as well as further steps referenced herein, including but not limited to rotation of turntable 20, movement of film carriage 15 on support column 12, the unwinding of film roll 40 and the application of heat seal mechanism 17 is controlled and coordinated by a programmable logic controller (PLC) (not shown). The PLC is programmed to actuate and coordinate each of the wrapping steps in a sequenced manner in order that the wrapping operation is fully automated and can be controlled by a single operator at a control console (not shown).

Figure 2:
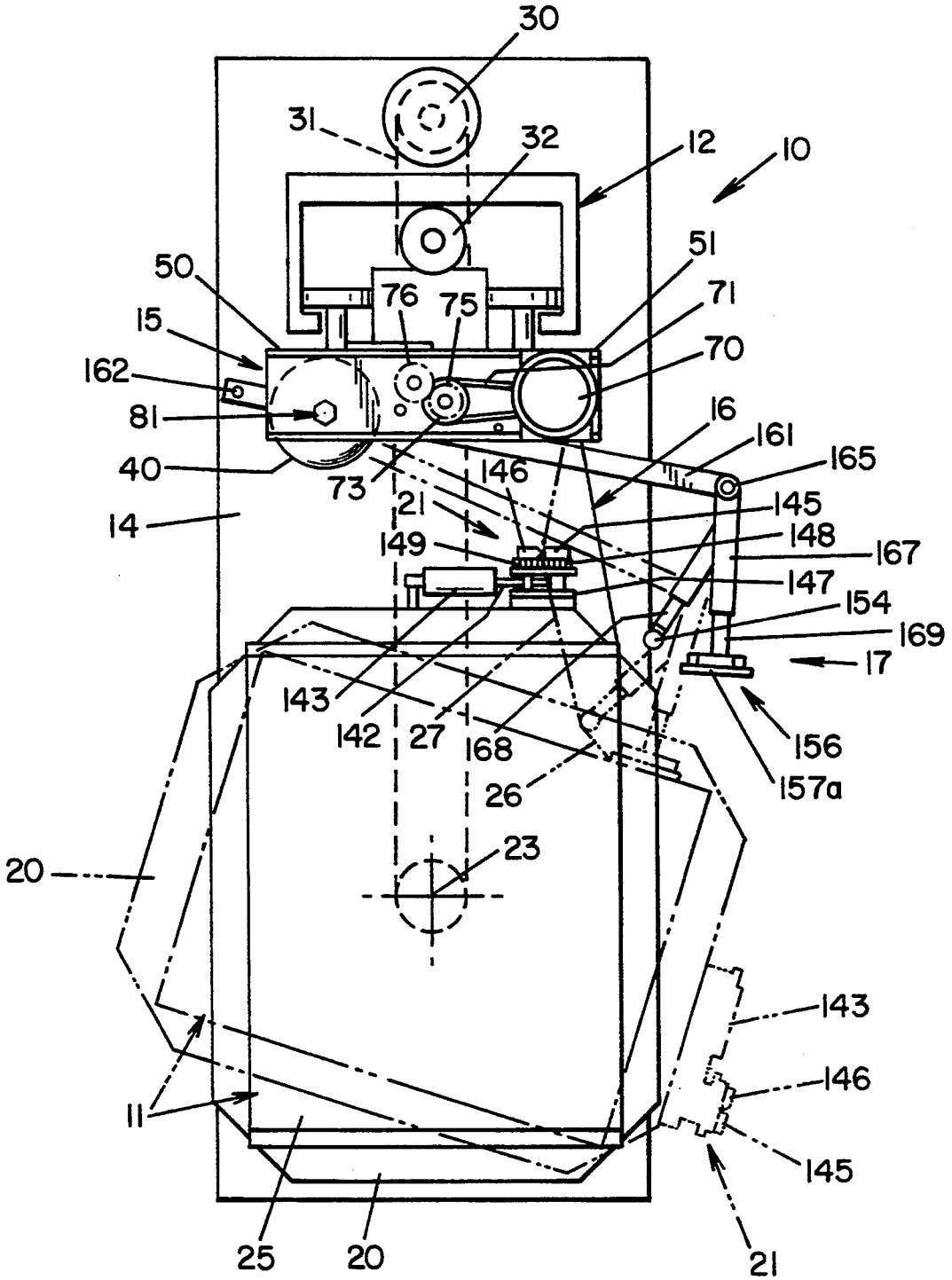
FIG. 2 is a plan view of the machine taken along line 2—2 of FIG. 1.

FIG. 2 shows in greater detail how wrapping machine 10 functions. Load motor 30 functions to drive turntable 20 about axis 23 by means of load drive belt or load drive chain 31. Film carriage 15 is preferably driven up and down in a vertical direction on support column 12 by carriage motor 32 which drives a drive chain (not shown).

Figure 3:
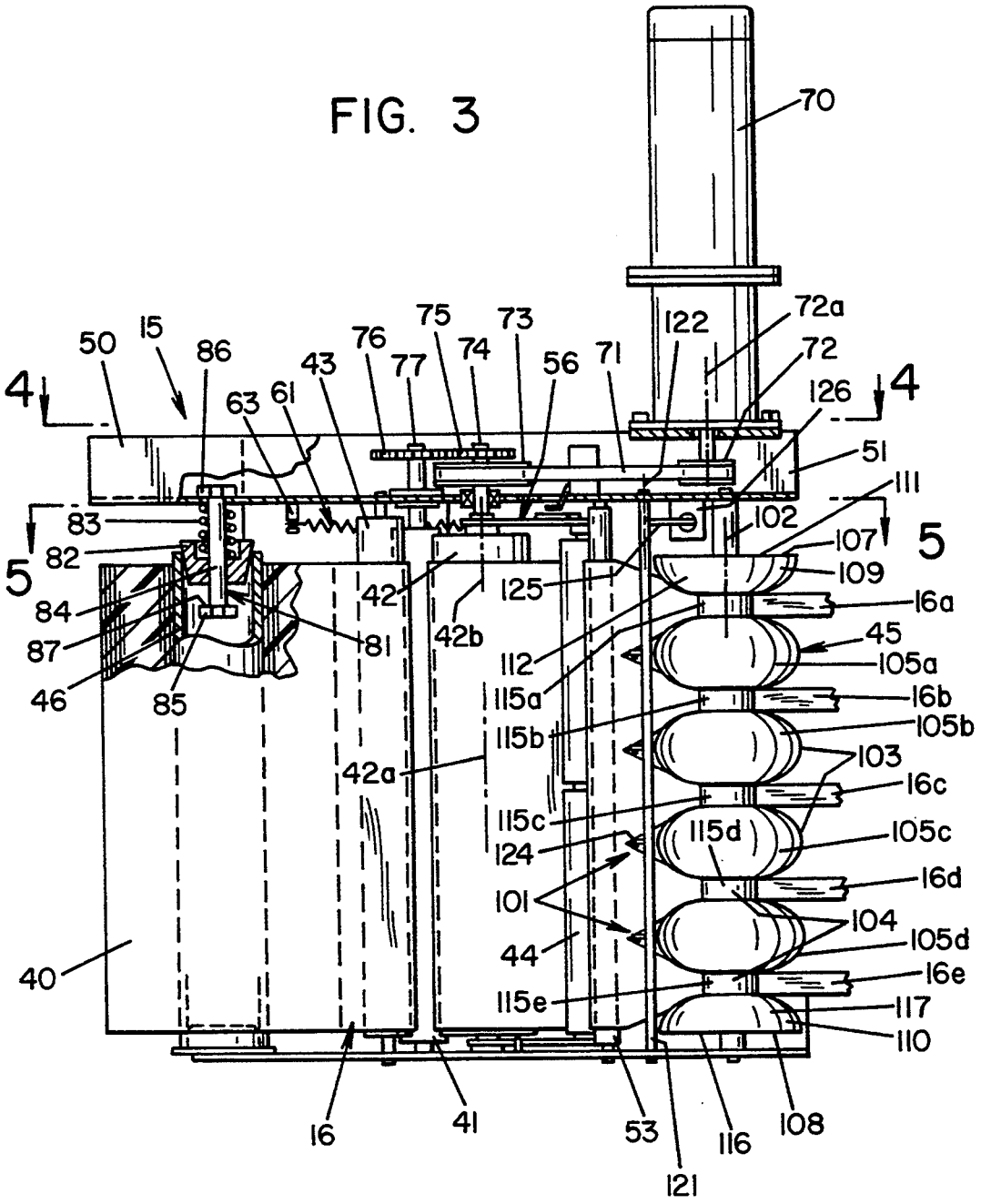
FIG. 3 is an enlarged view taken along line 3—3 of FIG. 1 showing the carriage of the wrapping machine in accordance with the present invention.
Figure 4:
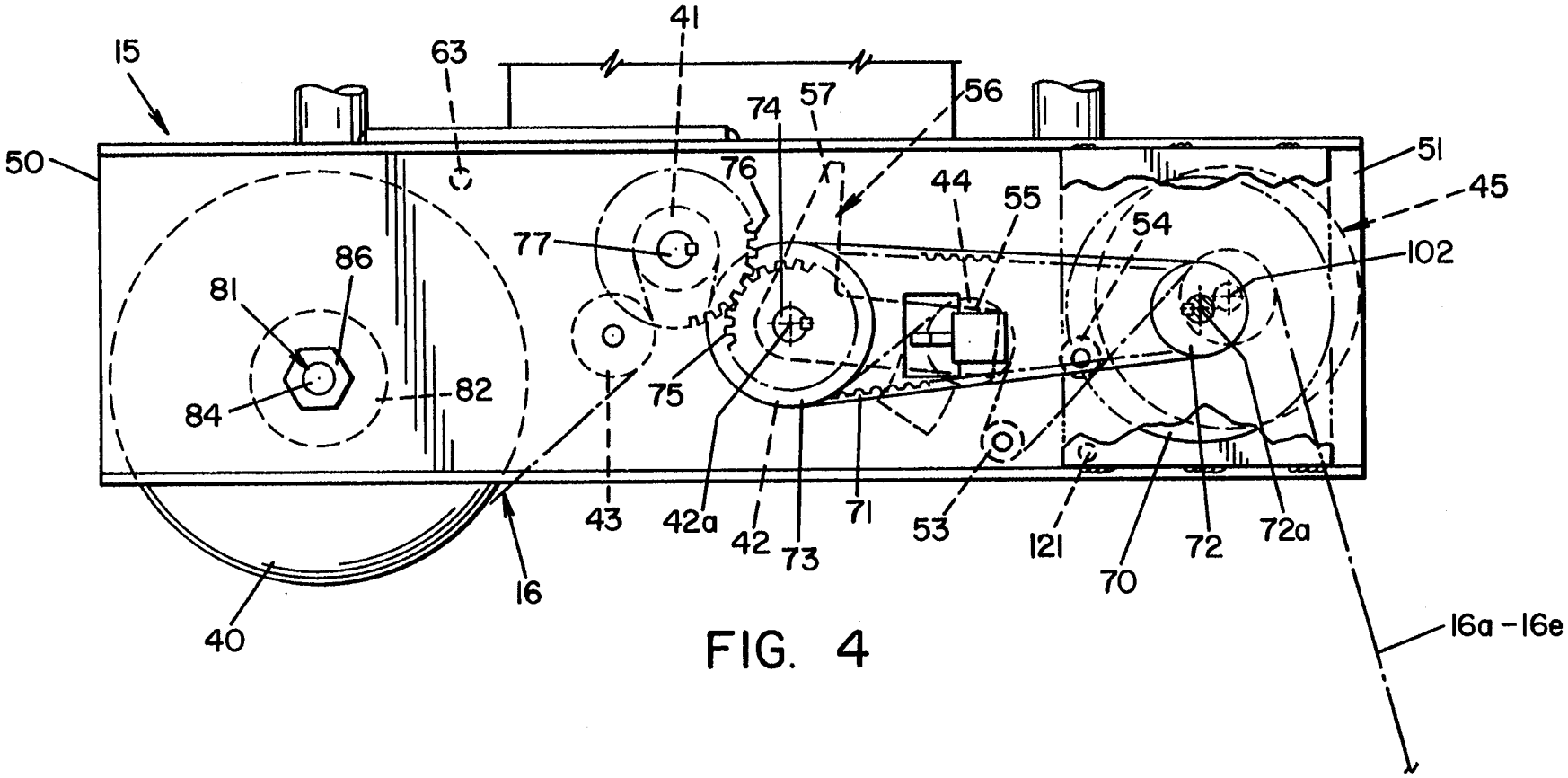
FIG. 4 is a plan view taken along line 4—4 of FIG. 3 showing the carriage of the present invention.
Figure 5:
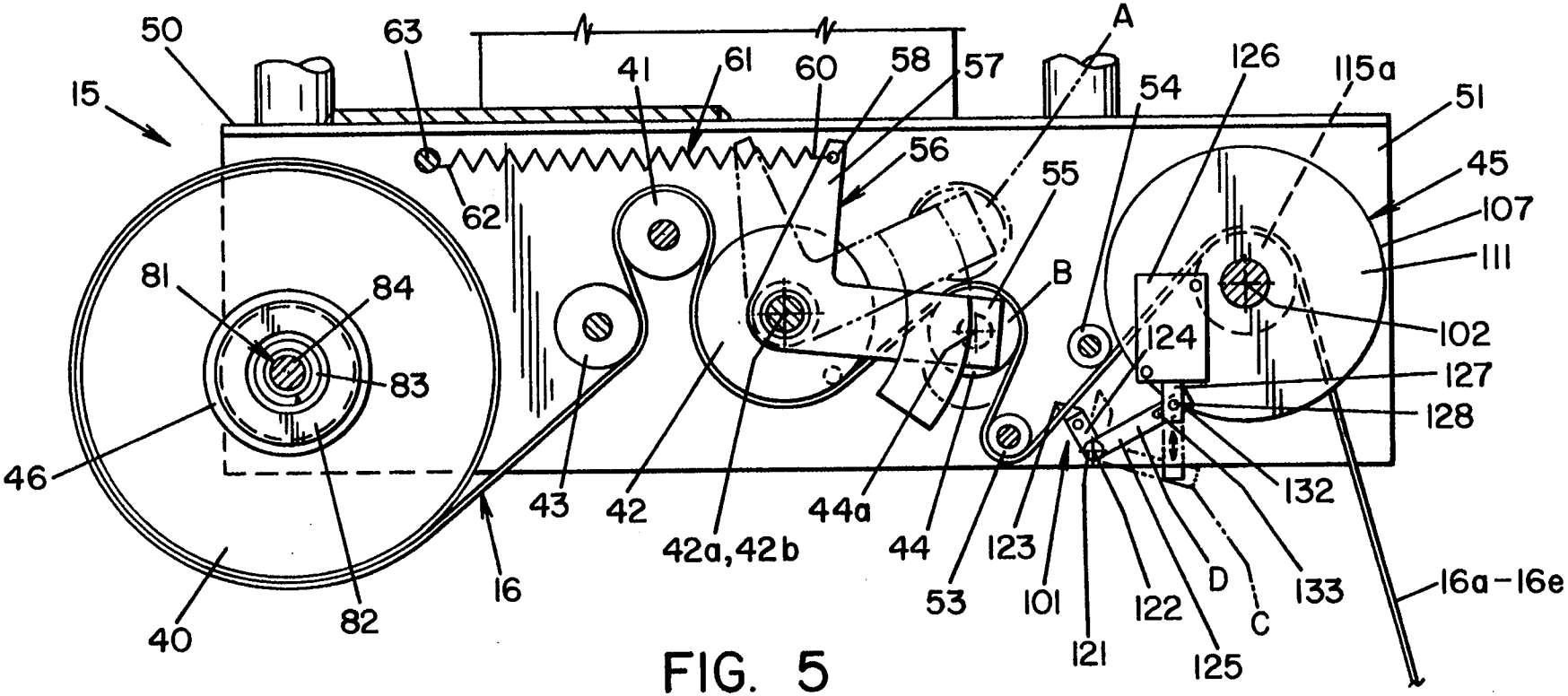
FIG. 5 is a cross-sectional view taken along line 5—5 of FIG. 3 showing the rollers and cutting apparatus of the present invention.

As best shown in FIGS. 3–5, film carriage 15 includes film roll 40 together with the main upstream prestretch roller 41 and the main downstream prestretch roller 42. Immediately upstream from prestretch roller 41 is located the guide rollers 43. Immediately downstream from prestretch roller 42 is the guide roller 44. While film roll 40 is disposed at the upstream end 50 of film carriage 15, a separating roller 45 is located at the downstream end 51 of film carriage 15. Between guide roller 44 and separating roller 45 are located the cutting rollers 53 and 54, respectively. Stretchable plastic film 16 is unrolled from film reel 40 and winds from an upstream 50 to a downstream 51 location as film 16 passes over guide roller 43 and upstream prestretch roller 41 and then over downstream prestretch roller 42 to guide roller 44. Upstream prestretch roller 41 has a particular upstream peripheral speed, while downstream prestretch roller 42 has a higher peripheral speed. Guide rollers 43, 44 ensure that film 16 is in contact with the prestretching rollers over a sufficient arc of a circle (for example, approximately 180°), as shown in FIGS. 4 and 5.

In the preferred embodiment, each prestretch roller 41, 42 has an outer surface allowing film 16 to catch and to limit or prevent sliding of film web 16 as film 16 passes over rollers 41, 42. Such surface is typically rubber or plastic. To allow easy adjustment for feeding of film 16 initially in film carriage 15, guide roller 44 is placed adjacent the large outer end 55 of a substantially L-shaped crank 56. At small outer end 57 of L-shaped crank 56 is located spring aperture 58 wherein a hook end 60 of tension spring 61 is placed. At pin end 62 of tension spring 61 is located a spring pin 63 where pin end 62 is secured. L-shaped crank 56 is allowed to pivot about axis **42*b*, which substantially conforms to axis 42*a*** about which downstream prestretch roller 42 rotates. By action of tension spring 61, guide roller 44 and axis 44*a* are preferably in position "A" during a wrapping cycle. However, during the initial phase in which film 16 is threaded into film carriage 15, it is preferable that guide roller 44 be placed in position "B" to facilitate the threading of film 16, a feature which is well known in the prior art. This feature also has specific advantages when wrapping a load in accordance with Applicant's invention since uneven tension placed on film 16 during the wrapping operation will cause spring 61 to elongate and L-shaped crank 56 to pivot, thus reducing stress in film 16 and preventing breakage of film web 16.

The means for driving rollers 41, 42 include prestretch motor means 70 in conjunction with prestretch drive belt 71. Motor 70 ensures the positive drive of belt 71 by drive spool 72 which rotates about axis 72*a* and prestretch drive spool 73 fixedly connected to prestretch pin 74 for rotating about axis 42*a*. Thus, as prestretch motor 70 causes drive spool 72 to rotate, prestretch drive belt 71 causes drive spool 73 and, thus, prestretch pin 74 and downstream prestretch roller 42 to rotate.

Upstream prestretch roller 41 is driven in a like manner by prestretch motor means 70. As outlined above, prestretch drive belt 71 translates rotation from prestretch motor means 70 to prestretch drive spool 73. Rotation is then transferred via prestretch pin 74 to a downstream gear 75. Downstream gear 75 then cooperates or meshes with an upstream gear 76, in order that rotation is transferred, via upstream pre-stretch pin 77 to upstream prestretch roller 41. This combination allows prestretch motor means 70 to drive main prestretch rollers 41, 42 via the cooperation between downstream gear 75 and upstream gear 76 in order to assure constant differential rotation. The differing upstream and downstream peripheral speeds of prestretch rollers 41 and 42, respectively, is achieved by differential gearing as is well known in the prior art and as best shown in FIG. 4.

As further shown in FIG. 4, the outside diameter of downstream gear 75 is less than the outside diameter of upstream gear 76 with which it cooperates. This results in downstream gear 75 completing one revolution prior to upstream gear 76. Thus, downstream prestretch roller 42 is driven at a greater peripheral speed than upstream prestretch roller 41. As discussed above, in the preferred embodiment, main prestretch rollers 41, 42 have an outside surface capable of catching and preventing the sliding of film 16 as it passes over each roller 41, 42. Thus, as downstream prestretch roller 42 is driven at a faster speed than upstream prestretch roller 41, film 16 is prestretched therebetween. The prestretching rollers can be of the same diameter or of different diameters. In an alternative embodiment, they can be positively motorized or driven by the running film. Furthermore, the stretching can be carried out in a plurality of steps, in which case a plurality of prestretching rollers is provided. The structure of various prestretching devices and various alternative versions thereof are not described in detail insofar as such prestretching devices with rollers at differential speeds is well known in the prior art. Thus, the generally S-shaped path which film 16 follows through the prestretch device, shown in FIGS. 3–5, is the preferred embodiment together with other features of Applicant's invention, which will be described in detail herein below.

For instance, carriage 15 is provided with a stopper pin 81 comprising a stopper 82, and a compression spring 83 in combination with a stopper shaft 84 and a stopper head 85 and a stopper nut 86. Stopper pin 81 allows easy changing of film roll 40 since stopper pin 81 can be grasped manually at stopper nut 86 and pulled upward, or alternatively rotated to raise stopper shaft 84, thereby engaging the underside 87 of stopper head 85 with stopper 82 and compressing compression spring 83 to remove stopper 82 from film roll tube 46 and allow film roll 40 to be removed from carriage 15. In a like manner, a new film roll 40 can be rotatably placed within carriage 15 by pulling upward or rotating stopper nut 86 allowing film roll 40 and film roll tube 46 to be placed in position and allowing compression spring 83 to force stopper 82 within film roll tube 46.

As best shown in FIGS. 3–5, film carriage 15 includes separating roller 45 and cutting edges 101 upstream of separating roller 45. In the preferred embodiment, cutting edges 101 work in unison to perforate and cut film 16 at points spaced along the width of film 16 to separate film web 16 into separate individual strips of film 16*a*, 16*b*, 16*c*, 16*d* and 16*e*. Separating roller 45 includes a separating axis 102, alternating peripheral ridges 103 and alternating peripheral grooves 104. Each peripheral ridge 103 is separated by a peripheral groove 104, and each peripheral groove 104 is separated by a peripheral ridge 103. Each of peripheral ridges 103 is formed by an elliptically-shaped bulb 105*a*, 105*b*, 105*c* and 105*d* having a generally convex outer shape, or alternatively, as at the upper end 107 of separating roller 45 and the lower end 108 of separating roller 45, by upper end bulb 109 and lower end bulb 110, respectively. Upper end bulb 109 has a flat, circular portion 111, which is generally horizontal and adjacent upper end 107 of support roller 45. Upper end bulb 109 has a generally convex surface 112 depending from the upper edge of circular surface 111 to intersect the bushing 115*a*, which forms a peripheral groove 104, between upper end bulb 109 and elliptical bulb 105*a*. In a like manner, lower end bulb 110 has a circular surface 116 generally horizontal, said circular surface 116 adjacent lower end 108 of separating roller 45. Further, lower end bulb 110 has a convex surface 117 which extends from the outer edge of circular surface 116 to intersect bushing 115*e*, which forms a peripheral groove 104, between lower end bulb 110 and elliptically-shaped bulb 105*d*.

Directly upstream of separating roller 45 is a cutting roller 54 and a cutting roller 53, respectively. As shown in FIGS. 4 and 5, film 16 passes over cutting roller 53 in a sufficient arc of a circle in order to direct film 16 toward separating roller 45. Adjacent to cutting rollers 53 and 54 is a cutting rod 121 located on a vertical cutting axis 122, cutting rod 121 being generally parallel to cutting rollers 53, 54. Extending outwardly from cutting rod 121, and generally perpendicular thereto, are cutting edges 101 comprising blades 123 and blade supports 124. Also extending perpendicularly from cutting rod 121 is rocker arm 125. As best shown in FIG. 5, a generally 90° included angle lies between each blade support 124 and rocker arm 125. Rocker arm 125 is connected to cutting actuator 126 via an actuator arm 127, with a push pin 128 depending therefrom. At rocker arm end 132 is located slot 133 within which push pin 128 is placed. As actuator arm 127 is moved laterally back and forth by cutting actuator 126, push pin 128 slides within slot 133 causing rocker arm 125 and cutting edges 101 to rotate about vertical cutting axis 122, as shown by the dotted lines in FIG. 5. Allowing cutting edges 101 to be mechanically connected to cutting actuator 126 provides several distinct advantages to film carriage 15 and allows versatility in wrapping a load 11.

For example, when actuator arm 127 is fully retracted within cutting actuator 126, as shown at position "D" in FIG. 5, blade 123 intersects film 16 in the path between cutting rollers 53, 54. This allows film 16 to be separated into separate, longitudinally extending film strips 16*a*, 16*b*, 16*c*, 16*d* and 16*e*, as shown in FIG. 3. Thus, load 11 may be wrapped in a manner which allows the palletized load to "breathe." However, in certain situations, it may be desirable to fully wrap the palletized load with uncut plastic film 16. This is especially true of users who run intermixed loads, which need the flexibility to wrap some loads with bands 16*a*–16*e* that allow load 11 to "breathe" and some loads 11 that require full film web 16 wrapping. Full film web 16 wrapping can be accomplished by engaging cutting actuator 126 to extend actuator arm 127 outwardly, as shown by the dotted lines of position "C" in FIG. 5. Engagement of cutting actuator 126 is accomplished either manually by a switch on carriage 15 or console (not shown), or controlled by the PLC. Extension of actuator arm 127 forces push pin 128 to slide within slot 133 causing rotation of rocker arm 125 and cutting edges 101 about vertical cutting axis 122, thus removing blades 123 from the path of film strip 16. Thus, full web wrapping can also be accomplished with the single film carriage 15. This eliminates time consuming changeover of machines or changeover of wrapping material such as between film 16 and netting as discussed hereinabove.

It will be appreciated that initially a full web of film 16 is placed in carriage 15 and threaded from upstream end 50 to downstream end 51 and over separating roller 45. Cutting edges 101 do not intersect film 16 and actuator arm 127 is fully extended to position "C", as shown in FIG. 5. When an operator of machine 10 desires to wrap a load with bands 16*a*–16*e* cutting actuator 126 causes actuator arm 127 to retract to position "D". Film 16 is initially pierced by blades 123 and then automatically forms into bands 16*a*–16*e* by the action of separating roller 45.

The shape of separating roller 45, the specifically alternating peripheral ridges 103 and peripheral grooves 104, causes the pierced strips of film 16 to slide between peripheral ridges 103 and into peripheral grooves 104 to form bands 16*a*–16*e*. Thus, a standard film roll 40 can be used to band load 11 with five separate bands 16*a*–16*e* at one time. In a preferred embodiment, a standard film roll 40 is twenty (20) inches wide. Thus, the width of film web 16 is also 20 inches. Cutting edges 101 are preferably spaced four (4) inches apart vertically along the width of film carriage 15. This equal spacing results in five film strips, which are initially 4 inches wide, prior to separation into bands 16*a*–16*e* in a direction transverse to the direction of the film.

As strips 16*a*–16*e* pass through peripheral grooves 104, some reduction in width occurs due to the width of each bushing 115*a*–115*e* and, due to necking of each band 16*a*–16*e* as additional tensile forces are placed thereupon each band 16*a*–16*e* between separating roller 45 and load 11. In a preferred embodiment, separating roller 45 is comprised of stainless steel parts, i.e. elliptically-shaped bulb 105, upper end bulb 109, lower end bulb 110 and bushings 115*a*–115*e*, whereupon plastic film 16 easily slides across the outer surface of separating roller 45 to form bands 16*a*–16*e*. Alternatively, any other type of material may be used which suitably reduces friction between separating roller 45 and plastic film 16.

Separating roller 45 is allowed to freely rotate about separating axis 102 in order to further reduce friction, which may occur between separating roller 45 and film 16 or film bands 16*a*–16*e*. Alternatively, separating roller 45 may be fixed relative to separating axis 102, whereupon film 16 or film strips 16*a*–16*e* slide over separating roller 45 or separating roller 45 may be driven to rotate at some peripheral speed which facilitates movement of film 16. Additionally, each of elliptically-shaped bulbs 105*a*–105*d*, upper end bulb 109, lower end bulb 110 and bushings 115*a*–115*e* can, in a separate embodiment, be allowed to freely rotate relative to the adjacent bushing 115 or adjacent bulb. However, it is preferable that each of individual elements, including upper end bulb 109, lower end bulb 110, elliptically-shaped bulbs 105*a*–105*d* and bushings 115*a*–115*e*, be joined to each of the adjacent bushings 115 or bulbs 105, 109, 110 of separating roller 45 in order to provide a homogenous separating roller 45 in which distances between adjacent bulbs 105, 109 or 110 do not vary. In the preferred embodiment, individual elements, bulbs 105, 109, 110 and bushings 115*a*–115*e*, are welded and/or machined by these or any other known methods to those skilled in the art.

Cutting rollers 53, 54, between which blades 123 are actuated to intersect film 16, uniquely provide lateral support to film 16 along its entire web width for better cutting of film 16 by blades 123 and along the longitudinal direction in which film 16 travels. The close proximity of cutting rollers 53, 54 provides for both the improved lateral and longitudinal support. Blades 123 are better able to initially pierce film 16, since film 16 is less likely to stretch or move in a direction lateral from the longitudinal downstream film direction. Thus, creasing or bunching of film 16 at blade 123 is prevented.

The prestretching step, implemented by prestretch rollers 41, 42 and guide rollers 43, 44 also significantly improves the cutting of film 16 into bands 16*a*–16*e* to be applied onto load 11. Specifically, prestretching reduces the elasticity of film 16 so that, when blades 123 are initially placed into the path of film 16, film 16 is initially pierced upon contact with blades 123 and does not instead move or stretch elastically in a direction lateral to the longitudinal downstream film direction. This problem has been experienced in the prior art, especially where blades 123 are not changed regularly. Thus, the invention also has the added benefit of reducing the need for constant changing of blades 123 since prestretching allows older blades 123 to be as effective as newer, sharper blades 123.

Prestretching also results in the thickness of film 16 being reduced. Therefore, blades 123 are not required to cut the same thickness of film material as which is dispensed from film roll 40. The prestretching step significantly reduces bunching of film 16 at blades 123. This bunching is the result of ineffective cutting along the entire thickness of film 16. Bunching can result in jamming of film carriage 15 with film 16, wherein the wrapping operation must be stopped and the jam cleared. Prestretching also reduces tearing of film 16 due to ineffective cutting or dull blades 123. At the very least, once film 16 begins to tear, the cutting step must be stopped. However, more often the entire wrapping operation must be stopped to clear the torn film from carriage 15.

Prestretching also results in a more economical wrapping operation and a cost savings since the same roll 40 of film 16 will wrap more of loads 11 with the same amount of film 16. A further cost savings is realized since there is less down time of wrapping machine 10 when film rolls 40 need not be changed as often.

Figure 6:
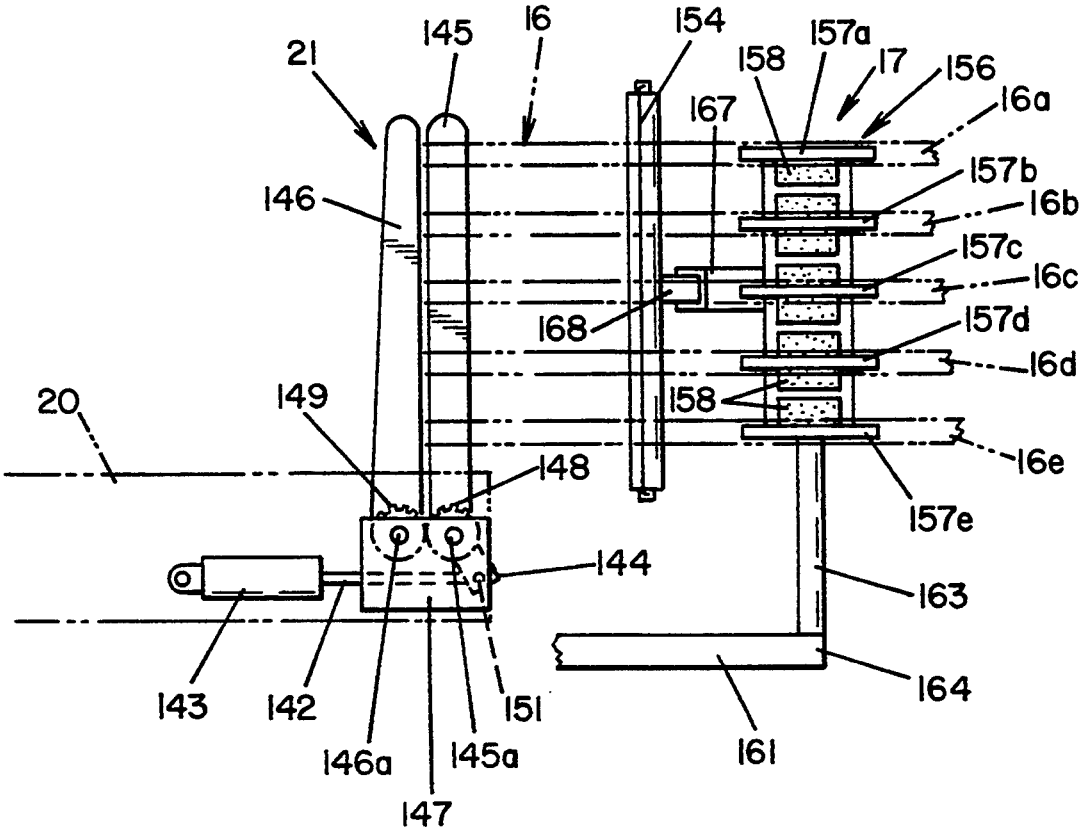
FIG. 6 is an enlarged view of the heating mechanism and clamp used to automate the wrapping operation and secure an end of the plastic film to the load.

In one embodiment of the present invention, as best shown in FIG. 6, wrapping machine 10 includes a heat seal mechanism 17 in combination with a clamp 21 wherein clamp 21 is positioned on turntable 20 of wrapping mechanism 10. In accordance with this embodiment of the present invention, wrapping film 16 is threaded through film carriage 15 and placed within clamp 21, which is downstream of separating roller 45. It will be appreciated that film 16 is retained substantially along its width within clamp 21.

Clamp 21 engages film 16 by means of a clamp actuator arm 142, which is attached at one end to piston 143 and at the other end to pivot arm 144. Gripper arms 145 and 146 are each supported by horizontal access rods 145*a* and 146*a*, respectively. Access rods 145*a* and 146*a* each have opposite ends, which are each rotatably attached to clamp base 147. Each of horizontal access rods 145*a*, 146*a* is fixedly attached adjacent one of its ends to clamp gears 148 and 149, respectively. Clamp gear 148 is also attached to one end of pivot arm 144, wherein the other end of pivot arm 144 is attached at 151 to clamp actuator arm 142. Thus, as piston 143 retracts actuator arm 142, pivot arm 144 causes gear 148 to rotate in a clockwise fashion, as shown in FIG. 6. Since clamp gear 148 and clamp gear 149 substantially cooperate or mesh, clockwise rotation of clamp gear 148 causes clamp gear 149 to rotate in a substantially counterclockwise fashion, thus causing gripper arms 145, 146 to separate and release film 16.

At the beginning of a wrap cycle, gripper arms 145, 146 retain film 16 therein. Turntable 20 begins to rotate causing film 16 to pay out from film carriage 15 as clamp 21 rotates with turntable 20. This causes film 16 to catch at consecutively one corner, then two corners, then three corners of load 11. Prior to film 16 catching on a fourth corner of load 11, clamp 21 is rotated to a substantially horizontal position (not shown) in order that film 16 may catch a fourth corner of the load without interference from clamp 21. The load can then be wrapped in a conventional, helicoidal manner without interference from clamp 21. As the load is continuously wrapped, the first layer is overlapped by a second layer which affixes the first layer to the load, thus eliminating the need for an alternative method of affixation. Clamp 21 may release the initial end of film 16 at any time prior to the end of the wrap cycle.

The embodiment illustrated at FIG. 1 and FIG. 6 makes it possible for bands of film coming from film carriage 15 to completely wrap and unitized load 11 at both the beginning and end of the wrap cycle. Previously, it was considered that the wrap cycle must be begun with at least one layer of film 16 which is uncut and of a full web width. Practically, this resulted in a layer of film adjacent bottom 24 and/or top 25 of load 11 approximately equal to the width of film 16, i.e. 20 inches. Additionally, the wrap cycle also required at least one layer of the full web width at the end of the wrap cycle. Previously, it was found that, if the wrap cycle was started using the bands of film 16*a*–16*e* cut from film roll 40, load 11 was not properly unitized. Since bands of film 16*a*–16*e* each individually required affixation to the load, prior art teaches that proper unitization requires a full width of film web 16 at the beginning and end of the wrap cycle. Stated differently, in the prior art the wrap cycle needed to be started with a full width of uncut film 16 within clamp 21 at the beginning of the wrap cycle. At the end of the wrap cycle, cutting of film 16 into bands of film 16*a*–16*e* was again ceased in order that a full width of film be applied to at least one layer of the load to facilitate unitization of load 11 and to allow the severed or terminal end 26 of film 16 to be affixed to the load by means such as stapling, welding, gluing or tying. The previous step of ceasing the cutting operation was necessary to avoid the undesirable result of manually affixing individual bands, such as bands 16*a*–16*e* to load 11.

The invention, as shown in FIG. 6, fully automates the wrapping operation. Clamp 21 is used in the conventional manner at the beginning of the wrap cycle in order to affix film 16 to load 11. After load 11 has been completely wrapped with film, clamp 21, which has already released initial end 27 of film 16, grips film 16 between gripper arms 145, 146 wherein hot wire 154 is electrified and hot piston 155 places hot wire 154 into a position wherein it intersects film 16 between clamp 21 and load 11, severing film 16. Concurrently, the hot pad 156 presses severed end 26 of film 16 against one side of load 11. Hot pad 156 includes heating elements 157*a*, 157*b*, 157*c*, 157*d* and 157*e*. These elements are preferably constructed of a metal conductor so that when electrified they heat up and, when placed against plastic film 16, weld the terminal end 26 of film 16 to an inner layer of plastic film 16 already placed upon load 11.

Hot pad 156 also includes insulation elements 158 spaced between heating elements 157*a*–157*e*. These elements are compressible and have a larger cross-section than heating elements 157*a*–157*e*. Insulation elements 158 are constructed of any of a number of known materials which are poor heat conductors and somewhat compressible. Therefore, the face of hot pad 156 which initially contacts load 11 is such that insulation elements must be compressed to expose heating elements 157*a*–157*e* to load 11. This provides a safety factor should an operator or other person brush up against hot pad 156 and additionally allows film web 16 or film bands 16*a*–16*e* to slide across hot pad 156 without melting or affecting the integrity of film 16 as it is applied to load 11. It will be appreciated that hot wire 154 results in the cutting of film 16 to form terminal end 26 and clamp 21 retains a new initial end 27 of film 16 so that the wrap operation may be repeated for a new load, thus fully automating the wrapping process.

Hot pad 156 is connected to base 14 via a pivot arm 161, which is in a substantially horizontal position wherein one end is rotatably connected at pivot point 162. At the opposite end 164, which is opposite pivot point 162, is located a vertical mast arm 163 which supports hot pad 156 and hot wire 154, both of which are cantilevered from the top end 165 of mast arm 163 by a cantilever coupling arm 167. Each of hot wire 154 and hot pad 156 are connected to coupling arm 167 by wire support member 168 and pad support member 169, respectively.

As best shown in FIG. 2, heat seal mechanism 17 is pivoted about pivot point 162 by hot piston 155 in order to sever or cut film 16 with hot wire 154, wherein severed end 26 of film 16 can be welded to load 111. Heat seal mechanism 17 is then pivoted about pivot point 162 to remove heat seal mechanism 17 from obstruction with turntable 20 during other portions of the wrapping cycle. Heat seal mechanism 17 uniquely allows a banded wrapping operation, of the type disclosed herein, to be fully automated and further provides that the entire load may be wrapped with banded film 16*a*–16*e*. Further, hot pad 156 enables each individual band of film 16*a*–16*e* to be individually welded automatically to load 11 by corresponding individual heating elements 157*a*–157*e* at the end of the wrap cycle and at the beginning, if desired. Hot pad 156 and heating elements 157*a*–157*e* can be customized in size and spacing to correspond to the size and spacing of film bands 16*a*–16*e*. Further insulation elements 158 can be customized in size and spacing to prevent hot pad 156 from heating portions of load 11, not covered by film bands 16*a*–16*e*.

Prior to Applicant's invention, the last layer of load 11 needed to be wrapped with a full width film web 16 in order to facilitate the attachment of severed end 26 of film 16 to load 11. Therefore, it was only necessary to tie off one film strip 16 versus individual bands of film, such as bands of film 16*a*–16*e*. However, such a method of wrapping is undesirable for the types of loads requiring banded film wrapping. The layers of load 11 which are completely wrapped in full width film 16 become completely sealed and are not allowed to "breathe." Where load 11 consists of, for instance fresh produce, hot-wrapped products or products palletized in a freezing environment, such sealing promotes condensation and/or spoiling of at least those layers of load 11 which are completely sealed. Thus, while the majority of the load is wrapped in an acceptable manner, those elements which are completely sealed risk spoiling as for produce or other problems which can be caused by uneven heating, cooling, or increased condensation.

Heat seal mechanism 17 of Applicant's invention eliminates the need for wrapping load 11 with the full width of uncut film 16 at the beginning or the end of the film wrap cycle. Further, the individual spacing of the heating elements 157*a*–157*e* are placed to preferably coincide with the spacing between peripheral ridges 103 of separating roller 45. Thus, in the preferred embodiment, the centerline-to-centerline spacing between adjacent heating elements 157*a*–157*e* is four inches to coincide with the spacing between adjacent bands of film 16*a*–16*e*. This helps ensure that each of individual bands 16*a*–16*e* are exposed to heat from heating elements 157*a*–157*e* and ensures that each of individual bands of film 16*a*–16*e* are welded to load 11.

While considerable emphasis has been placed on the preferred embodiments herein illustrated and described, it will be appreciated that other embodiments of the invention can be made and that modifications can be made in the preferred embodiments without departing from the principles of the invention. For example, each of cutting edges 101 may be separately actuated to intersect the path of film 16. This would provide additional flexibility as to the size of film bands 16*a*–16*e* and the number of film bands 16*a*–16*e* applied to load 11. The size and number of film bands could also be varied by other means, including changing the number of cutting edges 101, changing the spacing between adjacent cutting edges 101 or changing the configuration of separating roller 45 to reduce or add to the number of elliptically-shaped bulbs 105 and/or bushings 115. Other prestretching means, as known in the prior art, can also be used in conjunction with cutting blades 101 and separating roller 45.

It will also be realized that the invention is applicable to any shape of load and that the type of wrapping machine used with the invention may also vary. Such variations may include overhead stretch wrap machines, five side wrapping machines or wrapping machines which incorporate a frame structure in combination with a rotable frame assembly as described in Haloila, U.S. Pat. No. 4,587,796. Further, heat seal mechanism 17 is preferably used only at the end of the wrap cycle. However, alternatively, initial end 27 of film 16 may be affixed using heat seal mechanism 17. This further provides load 11 with greater unitization and increases the integrity of the film wrapped about load 11. These and other modifications of the preferred embodiments, as well as other embodiments of the invention, will be suggested or obvious from the embodiments disclosed herein, whereby it is to be distinctly understood that the foregoing descriptive matter is to be interpreted merely as illustrative of the invention and not as a limitation.

Having thus described the invention, it is claimed:

1. An apparatus for wrapping a palletized load with stretchable plastic film, said apparatus comprising:

a spool of film on a film carriage;

a prestretching apparatus for stretching said film before it is applied to said load;

means for piercing said film and applying said film to said load in a controlled manner, said means for piercing including cutting means for slitting said film into longitudinally extending strips, and means for separating said longitudinally extending strips into bands by placing spaces therebetween, said prestretching apparatus stretching said film prior to said piercing of said film by said means for piercing; and, means for relatively moving one of said film carriage and said load relative to the other in a generally vertical direction in combination with a means for relatively rotating one of said spool of film and said load relative to the other for applying said bands of film to said load.

2. The apparatus of claim 1, wherein said apparatus includes means for retracting said piercing means.

3. The apparatus of claim 1, wherein said cutting means includes at least one cutting edge pivotally mounted upon a vertical cutting axis.

4. The apparatus of claim 3, wherein said film travels in a longitudinal path through said film carriage and said cutting edge has a blade thereon, said blade orientated to pivot into said path of said prestretched film.

5. The apparatus of claim 1, wherein said prestretching apparatus includes at least two prestretching rollers for stretching said film.

6. The apparatus of claim 1, wherein said means for separating includes a separating roller having a vertical axis and alternating peripheral ridges and peripheral grooves.

7. The apparatus of claim 1, wherein said film travels in a path through said film carriage and said cutting means includes at least one blade pivotably mounted on a vertical cutting axis.

8. The apparatus of claim 7, wherein said at least one blade is disposed transverse to said vertical cutting axis and parallel to the path of said film wherein said blade corresponds to one of said peripheral ridges of said separating roller.

9. The apparatus of claim 8, wherein there are four blades adjacent to each other, and at least four peripheral ridges, each of said blades disposed transverse to said vertical cutting axis and parallel to the path of said film wherein each said blade corresponds with one of each said peripheral ridges of said separating roller.

10. The apparatus of claim 6, wherein each of said longitudinally extending strips are transversely separated into distinct bands as each strip passes over said separating roller.

11. The apparatus of claim 10, wherein each of said longitudinally extending strips are separated by each passing through said peripheral grooves.

12. The apparatus of claim 11, wherein each said strip is separated into a band having a transverse width generally equal to the width of one of said peripheral grooves between adjacent cutting blades.

13. The apparatus of claim 12, wherein each said band is adjacent to at least one other said band, the transverse spacing between adjacent bands generally equal to the transverse width of one of said peripheral ridges.

14. The apparatus of claim 1, wherein said apparatus further includes an automatic heat sealing means for affixing said film to said load.

15. A film carriage for placing upon a wrapping machine for wrapping a palletized load with stretchable plastic film, said film carriage comprising:

a spool of film rotatably mounted on said carriage;

means for unwinding said film from said spool from an upstream unwinding position to a downstream position in accordance with a selected film path;

prestretching roller means for stretching said film;

means for piercing said film, said means for piercing including cutting means for slitting said film into longitudinally extending strips and located in a downstream position from said prestretching roller means; and means for separating said longitudinally extending strips into bands by placing spaces therebetween.

16. The film carriage of claim 15, wherein said prestretching roller means includes at least two prestretching rollers.

17. The film carriage of claim 15, wherein said film carriage includes means for retracting said piercing means.

18. The film carriage of claim 15, wherein said cutting means includes at least one cutting edge pivotally mounted upon a cutting axis generally transverse to said film path.

19. The film carriage of claim 18, wherein said cutting edge has a blade thereon orientated to pivot into said path of said prestretched film.

20. The film carriage of claim 19, wherein said means for separating includes a separating roller having a separating axis generally transverse to said film path and alternating peripheral ridges and peripheral grooves.

21. The apparatus of claim 20, wherein said cutting means includes at least one blade mounted pivotally on a cutting axis generally parallel to said separating axis.

22. The film carriage of claim 20, wherein each of said longitudinally extending strips are transversely reduced in width as each strip passes through a peripheral groove.

23. The film carriage of claim 20, wherein said at least one blade is perpendicular to said cutting axis.

24. The film carriage of claim 23, wherein there are four blades adjacent to each other, and at least four peripheral ridges.

25. The film carriage of claim 20, wherein each said strip is separated into a band having a transverse width generally equal to the width of one of said peripheral grooves.

26. The film carriage of claim 25, wherein each said strip is adjacent to at least one other said strip, the transverse spacing between adjacent strips generally equal to the transverse width of one of said peripheral ridges.

27. The film carriage of claim 15, wherein said film has a transverse width, said width generally equal to about 20 inches.

28. The film carriage of claim 27, wherein said film is slit into five longitudinally extending strips.

29. The film carriage of claim 28, wherein there is a spacing between adjacent blades, said spacing is generally about 4 inches.

30. A method for wrapping a palletized load with stretchable plastic film during a wrapping cycle, said method comprising the steps of:

providing a spool of film;

unwinding said film from said spool from an upstream position to a downstream position in accordance with a selected path where it is applied to said load;

piercing said film along said path into longitudinally extending strips with a piercing apparatus;

providing a prestretching apparatus upstream of said piercing apparatus;

prestretching said film prior to piercing said film;

applying said pierced film to said load in a controlled manner, said piercing including cutting and slitting said film into transversely extending strips;

separating said strips into bands and placing spaces therebetween; and moving one of said perforated film and said load relative to the other in a direction transverse to said path and for unwinding said film, rotating one of said spool of film and said load relative to the other and applying said bands of film to said load.

31. The method of claim 30, wherein said wrapping cycle includes a beginning portion, a second portion and an end portion, pivoting said piercing apparatus in a disengaged position from said path at said beginning portion, pivoting said piercing apparatus into said path and into contact with said film thereby slitting said film web into said longitudinally extending strips during said second portion, and pivoting said piercing apparatus from said path during said end portion.

32. The method of claim 31, wherein said beginning portion includes automatically affixing said film to said load by heating said film on said load.

33. The method of claim 31, wherein said cycle includes a beginning portion, a second portion and an end portion, wherein said end portion includes automatically affixing said bands of film to said load by heating each of said bands on said load.

34. The method of claim 33, wherein said beginning portion comprises affixing said bands of film to said load by heating said bands on said load.

35. An apparatus for wrapping a palletized load with stretchable plastic film, said apparatus comprising:

a spool of film on a film carriage;

means for unwinding said film from said spool from an upstream unwinding position to a downstream position in accordance with a selected path where it is applied to said load;

prestretching roller means for stretching said film before it is applied to said load;

means for piercing said film and applying said film to said load in a controlled manner, said means for piercing located downstream of said prestretching roller means, said means for piercing further including cutting means for slitting said film into longitudinally extending strips;

means for separating said longitudinally extending strips into bands by placing spaces therebetween; and means for relatively moving one of said fill carriage and said load relative to the other in a direction transverse to said path in combination with means for relatively rotating one of said spool of film and said load relative to the other for unwinding said film and for applying said bands of film to said load.

36. Apparatus for wrapping a palletized load with stretchable plastic film, said apparatus comprising:

a spool of film on a film carriage;

means for piercing said film and applying said film to said load in a controlled manner, said means for piercing including cutting means for slitting said film into longitudinally extending strips, and means for separating said longitudinally extending strips into bands by placing spaces therebetween;

prestretching roller means for stretching said film before it is applied to said load;

automatic heat sealing means between said film carriage and said load for affixing an end of said film to said load, including a hot pad comprising a plurality of individual heating elements separated by a plurality of individual insulating elements; and means for relatively moving one of said film and said load relative to the other in a generally vertical direction in combination with means for relatively rotating one of said spool of film and said load relative to the other for applying said bands of film to said load.

37. A method for wrapping a palletized load with stretchable plastic film during a wrapping cycle with a wrapping machine, said method comprising the steps of:

providing a spool of film;

unwinding said film from said spool from an upstream position to a downstream position in accordance with a selected path where it is applied to said load;

providing a pair of prestretching rollers;

prestretching said film between said prestretching rollers before it is applied to said load;

piercing said film along said path into longitudinally extending strips after it has been prestretched;

applying said pierced film to said load in a controlled manner, said piercing including cutting and slitting said film into transversely extending strips;

separating said strips into bands and placing spaces therebetween;

moving one of said perforated film and said load relative to the other in a direction transverse to said path and rotating one of said spool of film and said load relative to the other for unwinding said film and applying said bands of film to said load;

stopping said piercing step towards the end of said wrapping cycle wherein said load is wrapped in at least one layer with a full width of film;

severing said film from said wrapping machine to form a severed end of film on said load; and heating said film adjacent said severed end to permanently affix said severed end of said film to said load.

38. The apparatus of claim 36, said automatic heat sealing means being pivotably mounted for actuation between said film carriage and said load.

39. The apparatus of claim 36, wherein said automatic heat sealing means includes a hot wire adjacent said hot pad and pivotable therewith for cutting said film.

* * * * *